US005375970A

United States Patent [19]

Iwai et al.

[11] Patent Number: 5,375,970

[45] Date of Patent: * Dec. 27, 1994

[54] CIRCUMFERENTIAL FLOW TYPE LIQUID PUMP

[75] Inventors: Shingo Iwai; Hiroshi Yoshioka, both of Hiroshima, Japan

[73] Assignee: Mitsubishi Denki Kabushiki Kaisha, Tokyo, Japan

[ * ] Notice: The portion of the term of this patent subsequent to Jun. 22, 2010 has been disclaimed.

[21] Appl. No.: 853,792

[22] Filed: Mar. 19, 1992

[30] Foreign Application Priority Data

May 14, 1991 [JP] Japan ..... 3-109161

[51] Int. Cl.[5] ..... F04D 5/00

[52] U.S. Cl. ..... 415/55.1; 415/169.1

[58] Field of Search ..... 415/55.4, 55.1, 55.2, 415/55.3, 55.5, 169.1

[56] References Cited

U.S. PATENT DOCUMENTS

| | | | |
|---|---|---|---|
| 4,586,877 | 5/1986 | Watanabe et al. | 415/55.1 |
| 4,591,311 | 5/1986 | Matsuda et al. | 415/53 |
| 4,793,766 | 12/1988 | Kumata | 415/55.1 |
| 4,915,582 | 4/1990 | Nishikawa | 415/55.1 |
| 5,009,575 | 4/1991 | Hanai et al. | 415/55.1 |
| 5,192,184 | 3/1993 | Nobuo et al. | 415/55.1 |
| 5,221,178 | 6/1993 | Yoshioka et al. | 415/55.1 |

FOREIGN PATENT DOCUMENTS

| | | | |
|---|---|---|---|
| 138297 | 7/1985 | Japan | 415/55.1 |
| 160192 | 7/1991 | Japan | 415/55.1 |
| 31660 | 2/1992 | Japan | 415/55.1 |
| 1262117 | 10/1986 | U.S.S.R. | 415/55.2 |

*Primary Examiner*—John T. Kwon
*Attorney, Agent, or Firm*—Leydig, Voit & Mayer

[57] ABSTRACT

A circumferential flow type liquid pump has, and a pump casing including a pump base and a pump cover. The pump casing rotatably supports an impeller and defines an elongated arcuate pump flow path along the outer periphery of the impeller and a suction inlet and a discharge outlet at both ends of the pump flow path. A plurality of gas venting holes are formed in a sliding surface of the pump cover along the pump flow path and communicate with the outside of the pump. Bubbles formed in the fuel in the pump flow path are positively discharged out of the pump casing assembly, and no vapor lock is caused.

16 Claims, 2 Drawing Sheets

CIRCUMFERENTIAL FLOW TYPE LIQUID PUMP

BACKGROUND OF THE INVENTION

This invention relates to circumferential flow type liquid pumps, and more particularly to a circumferential flow type liquid pump used as a fuel pump for pumping a liquid-phase fuel such as gasoline from the fuel tank into an internal combustion engine of a vehicle.

FIGS. 6 through 8 are sectional views showing a conventional circumferential flow type liquid pump as disclosed, for instance, by Japanese Published Unexamined Patent Application No. 79193/1985 In these figures, reference numeral 100 designates a pump casing assembly which is made up of a pump casing 110 comprising a pump base 1 and a pump cover 2, and an impeller 3 rotatably supported in the pump casing 110. The impeller 3 has vanes 3A in its outer periphery and is mounted on a shaft 4 so that it is rotated around its central axis with respect to the pump casing assembly 100.

The pump casing assembly 100 defines an arcuate pump flow path 5 elongated along the outer periphery of the impeller 3 and a suction inlet 2A and a discharge outlet 1A which are opened at both ends of the pump flow path 5. The pump flow path 5 receives the vanes 3A of the impeller 3. The pump flow path 5 is made up of recesses 1B and 2B which are formed in the pump base 1 and the pump cover 2.

The end portion of the pump flow path 5 which is on the side of the suction inlet 2A where the internal pressure is low is formed into an arcuate enlarged flow path 5A having a predetermined length which is larger in section than the remaining portion, and has a step 5B at the end where the sectional area is decreased; in other words, the remaining portion of the pump flow path 5 between the step 5B and the discharge outlet 1A is smaller in sectional area than the enlarged flow path 5A, and accordingly higher in internal pressure than the latter. A small hole, namely, a gas venting hole 2C is formed in the enlarged low path 5A near the step 5B so that the pump flow path 5 is communicated with the outside of the pump casing assembly.

The shaft 4 of the rotor 11 of an electric motor 10, coupled to the pump casing assembly 100 is rotatably supported by bearings 12 and 13. The pump casing assembly 100 is coupled to an end cover 14 through the yoke 15 of the motor 10. The end cover 14 has a pump discharge outlet 1A for supplying liquid, for instance, to an engine (not shown). The yoke 15 accommodates the rotor 11, and forms a liquid chamber 16 between the pump casing assembly 100 and the end cover 14 to store a liquid such as a liquid-phase fuel discharged through the discharge outlet 1A. Permanent magnets 17 serving as stator, and brushes 19 in sliding contact with the commutator 18 of the rotor 11 are provided inside the yoke.

The operation of the circumferential flow type liquid pump thus constructed will be described.

As the impeller 3 is rotated clockwise, in FIG. 7, by the electric motor 10, a liquid such as a liquid-phase fuel is sucked into the pump flow path 5 through the suction inlet 2A at the end. The liquid thus sucked is increased in pressure by the fluid friction resistance which is provided by high speed rotation of the vanes 3A of the impeller in the pump flow path 5, so that it is caused to flow clockwise in FIG. 7, and then flow through the discharge outlet 1A at the other end into the liquid chamber 16. In this operation, the vanes of the impeller contact the liquid, so that the liquid is partially vaporized, thus forming bubbles in the liquid. The bubbles thus formed are discharged out of the pump casing assembly 100 through the gas venting hole 2C near the step 5B in the enlarged flow path.

When, in a circumferential flow type liquid pump used as a fuel pump, bubbles are formed in the pump flow path by vaporization of the fuel and stayed therein, so-called "vapor locking" may be caused to obstruct the flow of liquid, thus lowering the pumping capacity greatly. In order to overcome this difficulty, in the above-described conventional circumferential flow type liquid pump, the gas venting hole is formed in the pump cover so that the intermediate portion of the pump flow path is communicated with the outside of the pump casing assembly. Thus, the bubbles formed in the pump flow path by vaporization of the liquid are discharged out of the pump casing assembly through the gas venting hole.

However, since the gas venting hole is formed in the bottom of the enlarged flow path, the liquid friction force is not sufficiently transmitted, and the bubbles formed in the pump flow path when the vanes of the impeller contact the liquid are caused to flow along the inner circular periphery of the pump flow path and near the impeller because of the difference between the bubbles and the liquid both in centrifugal force and in specific gravity, and the liquid friction resistance is further decreased. Thus, it becomes impossible to discharge the liquid and bubbles from near the bottom of the pump flow path into the outside of the Dump casing assembly, and vapor locking may occur.

SUMMARY OF THE INVENTION

Accordingly, an object of this invention is to eliminate the above-described difficulties accompanying a conventional circumferential flow type liquid pump.

More specifically, an object of the invention is to provide a circumferential flow type liquid pump in which bubbles formed by vaporization of the fuel in the pump flow path are positively discharged out of the pump casing assembly, whereby no vapor locking is caused.

The foregoing object and other objects of the invention have been achieved by the provision of a circumferential flow type liquid pump with a pump casing assembly comprising an impeller with vanes in its outer periphery, and a pump casing including a pump base and a pump cover, the pump casing rotatably supporting the impeller and defining an elongated arcuate pump flow path along the outer periphery of the impeller and a suction inlet and a discharge outlet at both ends of the pump flow path. According to the present invention, a plurality of gas venting holes are formed in a sliding surface of the pump cover along the pump flow path and communicate with the outside of the pump.

In the liquid pump of the present invention, when the vanes of the impeller contact a liquid such as liquid-phase fuel in the pump flow path, the liquid is vaporized, thus forming bubbles in it. The bubbles thus formed are collected along the inner periphery of the pump flow path. The bubbles thus collected are discharged through the gap between the impeller and the sliding surface of the pump cover and through the gas venting holes into the outside of the pump. In this operation, the bubbles which are not discharged through the first gas venting holes, or the bubbles which are formed downstream of the first gas venting holes, are discharged through the other gas venting holes, i.e., the second gas venting hole, the third gas venting holes, and so on.

The nature, utility and principle of the invention will be more clearly understood from the following detailed description and the appended claims when read in conjunction with the accompanying drawings.

DETAILED DESCRIPTION OF THE INVENTION

Preferred embodiments of this invention will be described with reference to the accompanying drawings.

First Embodiment

Figure 1:
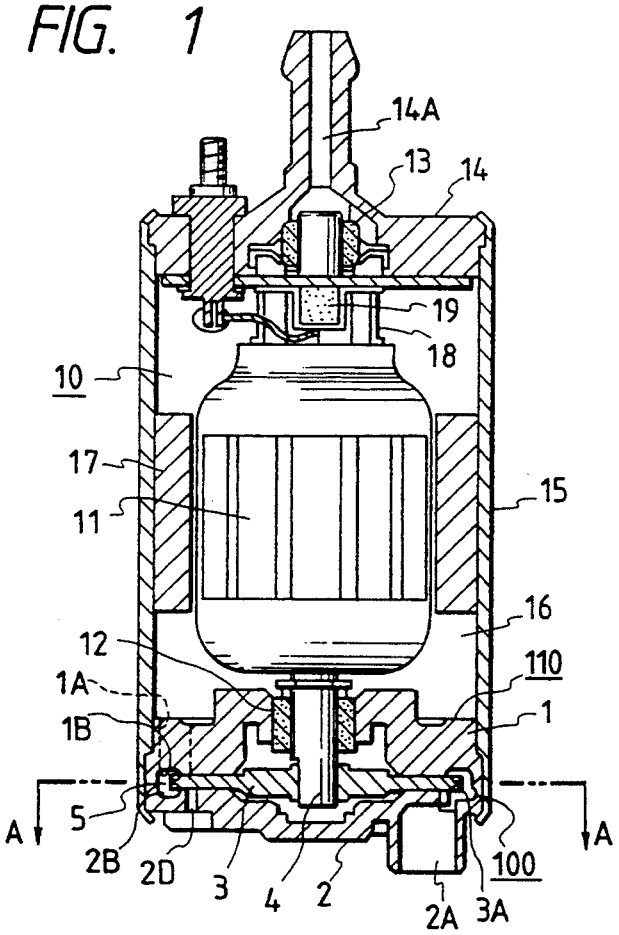
FIG. 1 is a vertical sectional view showing a circumferential flow type liquid pump, for a description of first through fifth embodiments of the invention.

An example of a circumferential flow type liquid pump, a first embodiment of this invention, will be described with reference to FIGS. 1 through 3.

In these figures, reference numeral 100 designates a pump casing assembly which comprises a pump casing 110 including a pump base 1 and a pump cover 2 and an impeller 3 rotatably supported inside the pump casing 110. The impeller 3 has vanes 3A in its periphery and is mounted on a shaft 4 so that it is rotated around the central axis with respect to the pump casing 110.

Figure 4:
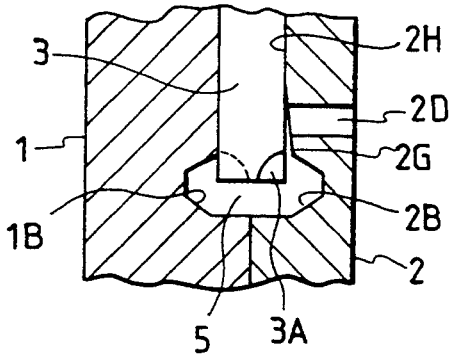
FIG. 4 is an enlarged sectional view for a description of the first and third embodiments of the invention for the first embodiment, the enlarged sectional view is taken along line B—B in FIG. 2, and for the third embodiment, it is taken along line B—B in FIG. 3.

In the pump casing assembly 100, an elongated arcuate pump flow path 5 with a suction inlet 2A and a discharge outlet. 1A at both ends is defined in such a manner that it is extended along the outer periphery of the impeller 3 and receives the vanes 3A of the impeller 3. The pump flow path 5 is made up of recesses 1B and 2B formed in the pump base 1 and the pump cover 2. The discharge outlet 1A is provided on the side of the pump base 1, and the suction inlet 2A on the side of the pump cover 2. In the pump cover 2, a plurality of gas venting holes 2D, 2E and 2F are formed in the impeller sliding surface 2H along the pump flow path 5 and are communicated with the outside of the pump. As shown in FIG. 4, the sliding surface 2H is separated from the bottom surface of recess 2B by a step. An extremely small annular slope 2G is formed in the sliding surface 2H along the periphery of the pump flow path 5 in such a manner that it slopes from the gas venting holes 2D, 2E and 2F towards the pump flow path and covers the entire periphery of the pump cover. The slope 2G provides a gap which resists the flow of liquid but scarcely resists the flow of gas. For instance, in the case where the pump casing 110 is about 50 mm in outside diameter, the gap is 20 to 30 μm. The structure of the circumferential flow type liquid pump of the invention is otherwise the same as that of the above-described conventional one. The slope 2G may be formed on the side of the impeller 3, or may be formed on both the sliding surface 2H and the side of the impeller 3.

Figure 2:
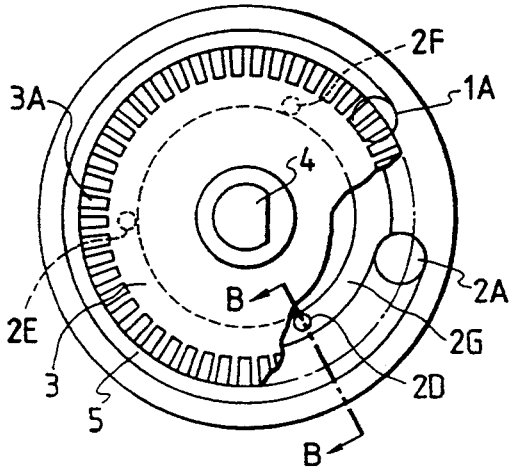
FIG. 2 is an enlarged sectional view taken along line A—A in FIG. 1, for a description of the first and second embodiments of the invention.
Figure 3:
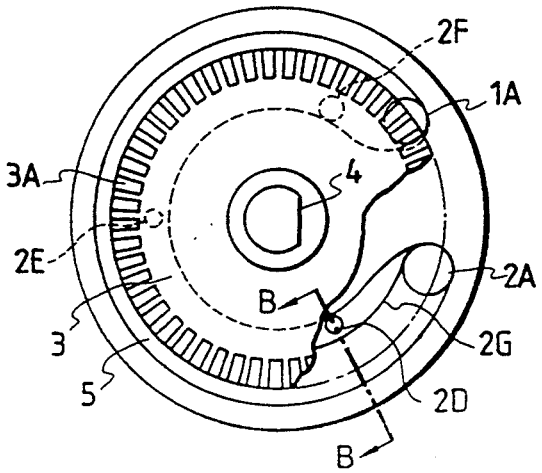
FIG. 3 is an enlarged sectional view taken along line A—A in FIG. 1, for a description of third and fourth embodiments of the invention.

In the circumferential flow type liquid pump thus constructed, as the impeller 3 is rotated clockwise in FIG. 2, by the electric motor 10, a liquid such as liquid-phase fuel is sucked into the pump flow path 5 through the suction inlet 1A. The liquid thus sucked flows clockwise in FIG. 2; that is, it flows through the discharge outlet 1A into the liquid chamber 6. During this pumping operation, the vanes 3A of the impeller 3 contact the liquid in the pump flow path 5 to vaporize it, thus forming bubbles in it. The bubbles thus formed are different from the liquid both in centrifugal force and in specific gravity. Hence, they are collected along the inner periphery of the pump flow path 5 and near the impeller 3. That is, the bubbles are pushed radially inwardly; i.e., towards the sliding surface 2H between the impeller 3 and the pump cover 2. As a result, only the bubbles are effectively discharged through the small gap provided by the slope 2H and through the gas venting holes. The bubbles which are not discharged through the first gas venting hole 2D or which are formed downstream of the first gas venting hole 2D are discharged through the second or third gas venting hole 2E or 2F.

Second Embodiment

Figure 5:
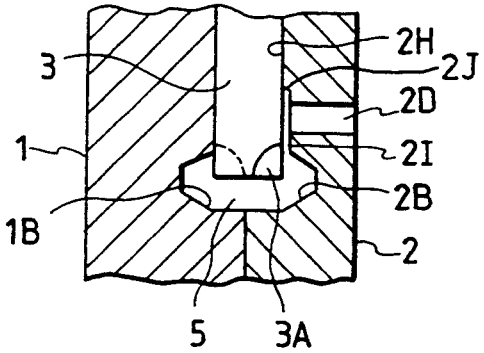
FIG. 5 is an enlarged sectional view for a description of the second and fourth embodiments of the invention for the second embodiment, the enlarged sectional view is taken along line B—B in FIG. 2, and for the fourth embodiment it is taken along line B—B in FIG. 3.
Figure 6:
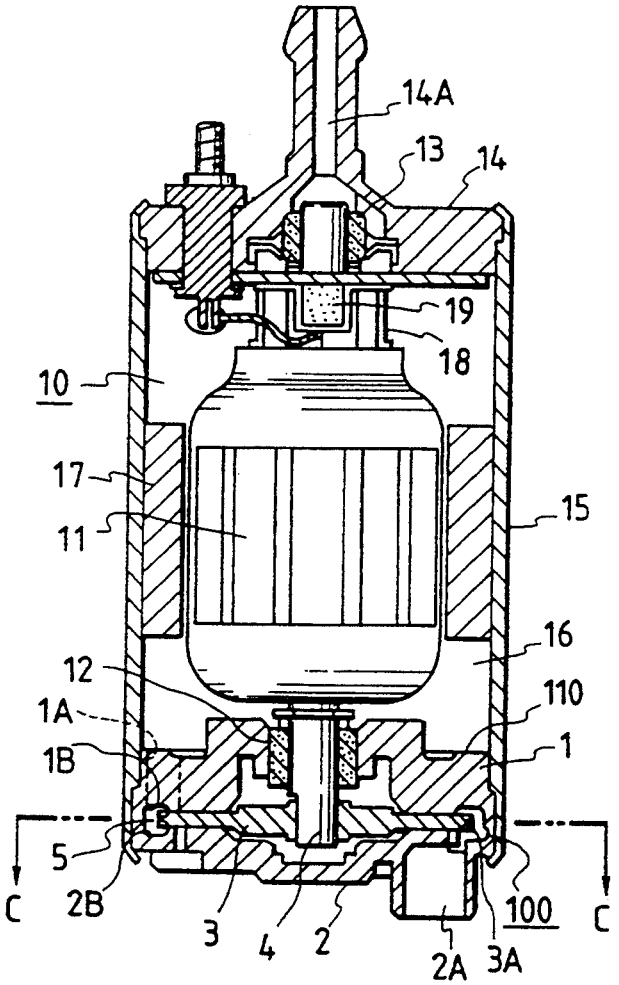
FIG. 6 PRIOR ART
FIG. 6 is a vertical sectional view of a conventional circumferential flow type liquid pump.
Figure 7:
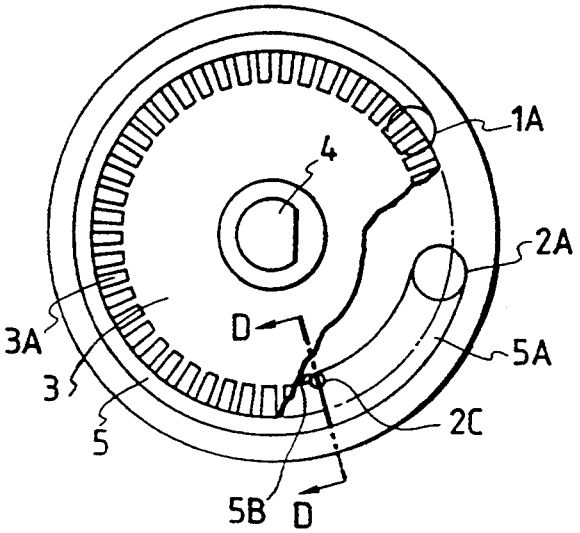
FIG. 7 PRIOR ART
FIG. 7 is an enlarged sectional view taken along line C—C in FIG. 6.
Figure 8:
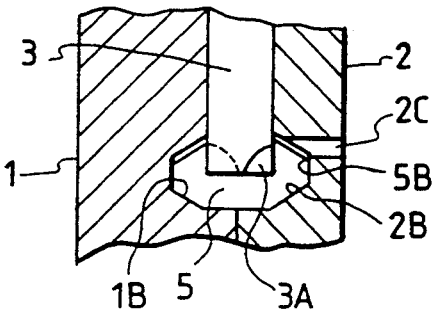
FIG. 8 PRIOR ART
FIG. 8 is an enlarged sectional view taken along line D—D in FIG. 6.

A second embodiment of the circumferential flow type liquid pump of this invention will be described. In the second embodiment, instead of the above-described slope 2G shown in FIG. 4, an extremely small ledge 2I as shown in FIG. 5 is employed. The ledge 2I is elongated along the pump flow path 5, and is axially spaced from and nearer the impeller 3 than the bottom of the recess 2B, as shown in FIG. 5. A plurality of gas venting holes 2D, 2E and 2F are formed in the ledge 2I along the pump flow path 5 and are communicated with the outside of the pump. An extremely small step 2J is formed in the sliding surface 2H along the inner periphery of the ledge 2I. As shown in FIG. 5, the height of step 2J is smaller than the height of the step separating the ledge 2I from the bottom of the recess. The ledge 2I may be formed on the side of the impeller 3, or may be formed on both the sliding surface 2H and the side of the impeller 3.

Third Embodiment

In the liquid pump shown in FIG. 2, the annular slope 2G is formed along the inner periphery of the pump flow path 5 in such a manner that it covers the entire periphery of the pump base, i.e., it extends for 360 degrees along the pump flow path 5. The slope 2G can be formed with ease. However, since it is extended over the part where no pump flow path is formed, the efficiency of the liquid pump is slightly lowered as much. This difficulty has been eliminated by a third embodiment of the invention. That is, in the third embodiment, as shown in FIG. 3, a slope 2G similar to the one shown in FIG. 4 is formed along the pump flow path 5 only between the suction inlet 2A and the discharge outlet 1A. Hence, the liquid pump according to the third embodiment is higher in efficiency than the one according to the first embodiment (FIG. 2).

Fourth Embodiment

A fourth embodiment of the invention may be obtained by slightly modifying the third embodiment described above. That is, in the fourth embodiment, a ledge 2I similar to the one shown in FIG. 5 is formed along the inner periphery of the pump flow path 5 only between the suction inlet 2A and the discharge outlet 1A.

Fifth Embodiment

It is not always necessary to form the above-described slope or ledge 2G, depending on the gap between the impeller 3 and the sliding surface 2H. That is, in the fuel pump with no slope or ledge, depending on the gap between the impeller and the slide surface, the bubbles can be discharged through the gas venting holes 2D, 2E and 2F which are arranged along the pump flow path 5 and communicated with the outside of the pump.

Effect(s) of the Invention

As was described above, a plurality of gas venting holes are formed in the part of the pump where bubbles are formed in the pump flow path collect; i.e., they are formed in the sliding surface of the pump cover which is in slide contact with the impeller. Hence, the bubbles (gas) which are not discharged through the first gas venting hole or the bubbles which are formed downstream of the first gas venting hole are discharged through the other gas venting holes, i.e., the second gas venting hole, the third gas venting holes, and so forth. Hence, the liquid pump of the invention can discharge the bubbles with high efficiency which the conventional liquid pump cannot. Thus, the liquid pump of the invention is high in pumping capacity and is free from the occurrence of vapor locking. The fuel pump in which the elongated small slope or ledge is formed along the pump flow path, and a plurality of gas venting holes are formed in the slope or the ledge, can discharge the bubbles more effectively.

While preferred embodiments of this invention have been described, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A circumferential flow type liquid pump with a pump casing assembly comprising: an impeller with vanes in the outer periphery thereof; and a pump Casing including a pump base and a pump cover, said pump casing rotatably supporting said impeller and defining an elongated arcuate pump flow path along the outer periphery of said impeller and a suction inlet and a discharge outlet at both ends of said pump flow path; in which said pump flow path is a recess formed between said pump base and said pump cover, and a plurality of gas venting holes are formed in the slide surface of said pump cover which is in slide contact with said impeller in such a manner that said gas venting holes are arranged along said pump flow path and communicated with the outside of said pump.

2. A circumferential flow type liquid pump with a pump casing assembly according to claim 1, further comprising slopes formed in said slide surface between an inner periphery of said pump flow path and said gas venting holes, each of said slopes sloping from the gas venting holes towards the pump flow path.

3. A circumferential flow type liquid pump with a pump casing assembly according to claim 1, further comprising an annular slope formed in said slide surface for 360 degrees along an inner periphery of said pump flow path and sloping from the gas venting holes towards the pump flow path.

4. A circumferential flow type liquid pump with a pump casing assembly according to claim 1, further comprising a slope formed in said slide surface along an inner periphery of said pump flow path only between said suction inlet and said discharge outlet and sloping from the gas venting holes towards the pump flow path.

5. A circumferential flow type liquid pump with a pump casing assembly according to claim 1, further comprising ledges formed in said slide surface between said pump flow path and said gas venting holes and connecting said pump flow path and said gas venting holes.

6. A circumferential flow type liquid pump with a pump casing assembly according to claim 1, further comprising an annular ledge formed in said slide surface along an inner periphery of said pump flow path.

7. A circumferential flow type liquid pump with a pump casing assembly according to claim 1, further comprising a ledge formed in said slide surface along an inner periphery of said pump flow path only between said suction inlet and said discharge outlet.

8. A circumferential flow type liquid pump comprising:

an impeller with vanes in the outer periphery thereof; and a pump casing including a pump base and a pump cover, said pump casing rotatably supporting said impeller and defining an elongated arcuate pump flow path along the outer periphery of said impeller and a suction inlet and a discharge outlet at both ends of said pump flow path; in which said pump flow path is a recess formed between said pump base and said pump cover, said recess including a first portion, an arcuate ledge is formed along the inner periphery of said pump flow path between said suction inlet and said suction outlet, said arcuate ledge and said first portion of the recess defining a step wherein the arcuate ledge is axially spaced from and nearer the impeller than the first portion of the recess, and a plurality of gas venting holes are formed in said ledge along said pump flow path and communicate with the outside of said pump.

9. A circumferential flow type liquid pump comprising:

a pump casing including a pump base and a pump cover defining a pump flow path having an inlet end, an outlet end, and a bottom surface, the pump cover having a sliding surface separated from the bottom surface of the pump flow path by a first step extending between the inlet end and the outlet end;

an impeller rotatably supported in the pump casing between the base and the cover; and a plurality of gas venting holes formed in the sliding surface along the pump flow path and communicating between the sliding surface and the outside of the pump.

10. A pump as claimed in claim 9 wherein the sliding surface has an annular sloping portion formed therein adjoining an upper end of the first step, the sloping portion extending at least between the inlet end and the outlet end of the pump flow path, wherein the gas venting holes are formed in the sloping portion.

11. A pump as claimed in claim 10 wherein a clearance between the sloping portion and the impeller increases in a radially outward direction of the impeller.

12. A pump as claimed in claim 10 wherein the slope is formed only between the inlet end and the outlet end of the pump flow path.

13. A pump as claimed in claim 10 wherein the slope extends for 360 degrees along the pump flow path.

14. A pump as claimed in claim 9 wherein the sliding surface has a ledge formed therein adjoining an upper end of the first step and extending at least between the inlet and the outlet end of the pump flow path, wherein the gas venting holes are formed in the ledge.

15. A pump as claimed in claim 14 wherein a second step is formed in the sliding surface along an inner periphery of the ledge.

16. A pump as claimed in claim 15 wherein the second step has a smaller height than the first step.

* * * * *